US009837715B2

(12) United States Patent
Sugimoto et al.

(10) Patent No.: US 9,837,715 B2
(45) Date of Patent: Dec. 5, 2017

(54) ANTENNA DEVICE

(71) Applicant: DENSO CORPORATION, Kariya, Aichi-pref. (JP)

(72) Inventors: Yuji Sugimoto, Kariya (JP); Tadao Suzuki, Kariya (JP); Hiroyuki Izumi, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 107 days.

(21) Appl. No.: 14/391,525

(22) PCT Filed: Apr. 1, 2013

(86) PCT No.: PCT/JP2013/002239
§ 371 (c)(1),
(2) Date: Oct. 9, 2014

(87) PCT Pub. No.: WO2013/153770
PCT Pub. Date: Oct. 17, 2013

(65) Prior Publication Data

US 2015/0061964 A1 Mar. 5, 2015

(30) Foreign Application Priority Data

Apr. 13, 2012 (JP) ..... 2012-092005

(51) Int. Cl.
*H01Q 21/00* (2006.01)
*H01Q 5/00* (2015.01)
(Continued)

(52) U.S. Cl.
CPC ..... *H01Q 5/0024* (2013.01); *H01Q 1/3275* (2013.01); *H01Q 5/30* (2015.01);
(Continued)

(58) Field of Classification Search
USPC ..... 343/893, 700 MS, 858
See application file for complete search history.

(56) References Cited

U.S. PATENT DOCUMENTS 7,136,022 B2 * 11/2006 Sato ..... H01Q 9/26 343/702
7,831,230 B2 * 11/2010 Nail ..... H04B 1/0057 333/126

(Continued)

FOREIGN PATENT DOCUMENTS

EP 2139065 A1 12/2009
JP H09181525 A 7/1997

(Continued)

OTHER PUBLICATIONS

Office Action dated Oct. 6, 2015 in corresponding Japanese Application No. 2012-92005.

(Continued)

*Primary Examiner* — Jessica Han
*Assistant Examiner* — Hai Tran
(74) *Attorney, Agent, or Firm* — Harness, Dickey & Pierce, P.L.C.

(57) ABSTRACT

An antenna device includes a first antenna element and a second antenna element. The first antenna element operates at a first predetermined frequency band. The second antenna element operates at a second predetermined frequency band that is different from the first predetermined frequency band. The first antenna element includes a base end portion, a front end portion, a folded portion, a first side portion disposed between the base end portion and the folded portion, and a second side portion disposed between the folded portion and the front end portion. A direction of a current vector in the first side portion is equal to a direction of a current vector in (Continued)

the second side portion. The second antenna element is disposed adjacent to the first antenna element.

15 Claims, 9 Drawing Sheets

(51) Int. Cl.
*H01Q 9/42* (2006.01)
*H01Q 21/30* (2006.01)
*H01Q 1/32* (2006.01)
*H01Q 5/30* (2015.01)

(52) U.S. Cl.
CPC ..... *H01Q 9/42* (2013.01); *H01Q 21/00* (2013.01); *H01Q 21/30* (2013.01)

(56) References Cited

U.S. PATENT DOCUMENTS

2005/0153756 A1* 7/2005 Sato ..... H01Q 1/243 455/575.7
2005/0195124 A1 9/2005 Puente Baliarda et al.
2008/0088517 A1* 4/2008 Ansari ..... H01Q 1/38 343/745
2008/0284659 A1 11/2008 Ikeyama

FOREIGN PATENT DOCUMENTS

JP 2004040596 A 2/2004
JP 2005203878 A 7/2005
JP 2005538623 A 12/2005
JP 2008289002 A 11/2008
JP 2009267806 A 11/2009
JP 2010004470 A 1/2010

OTHER PUBLICATIONS

International Search Report and Written Opinion (in Japanese with English Translation) for PCT/JP2013/002239, dated May 14, 2013; ISA/JP.

* cited by examiner

ANTENNA DEVICE

CROSS REFERENCE TO RELATED APPLICATION

This application is a U.S. National Phase Application under 35 U.S.C. 371 of International Application No. PCT/JP2013/002239 filed on Apr. 1, 2013 and published in Japanese as WO 2013/153770 A1 on Oct. 17, 2013. This application is based on and claims priority to Japanese Patent Application No. 2012-092005 filed on Apr. 13, 2012. The entire disclosures of all of the above applications are incorporated herein by reference.

TECHNICAL FIELD

The present disclosure relates to an antenna device including multiple antenna elements having respective operating frequency bands different from one another.

BACKGROUND ART

For example, patent literature 1 discloses a configuration in which multiple antenna elements operating at different frequency bands are disposed on a ground plate having a planar shape in a standing manner adjacent to one another.

However, in the configuration disclosed in patent literature 1, induced currents having current vectors in opposite directions are generated in the antenna elements disposed adjacent to one another by a coupling of the antenna elements disposed adjacent to one another. As a result, a gain of the antenna element is decreased caused by the flow of the induced current, and a desired directivity and a desired gain of the antenna element cannot be acquired.

PRIOR ART LITERATURES

Patent Literature

Patent Literature 1: JP H9-181525 A

SUMMARY OF INVENTION

In view of the foregoing difficulties, it is an object of the present disclosure to provide an antenna device including multiple antenna elements that properly provide an improved directivity and an improved gain.

According to an aspect of the present disclosure, an antenna device includes a first antenna element and a second antenna element. The first antenna element operates at a first predetermined frequency band. The second antenna element operates at a second predetermined frequency band that is different from the first predetermined frequency band. The first antenna element includes a base end portion, a front end portion, a folded portion, a first side portion disposed between the base end portion and the folded portion, and a second side portion disposed between the folded portion and the front end portion. A direction of a current vector in the first side portion is equal to a direction of a current vector in the second side portion. The second antenna element is disposed adjacent to the first antenna element.

With the above device, an induced current that generated and flows in the first antenna element disposed adjacent to the second antenna element can be restricted. The induced current in the first antenna element flows in a direction opposite to a direction of a current flow in the second antenna element. The first antenna element is able to provide an improved directivity and an improved gain even with a configuration in which multiple antenna elements having different operating frequency bands are disposed adjacent to one another.

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION

First Embodiment

Figure 1:
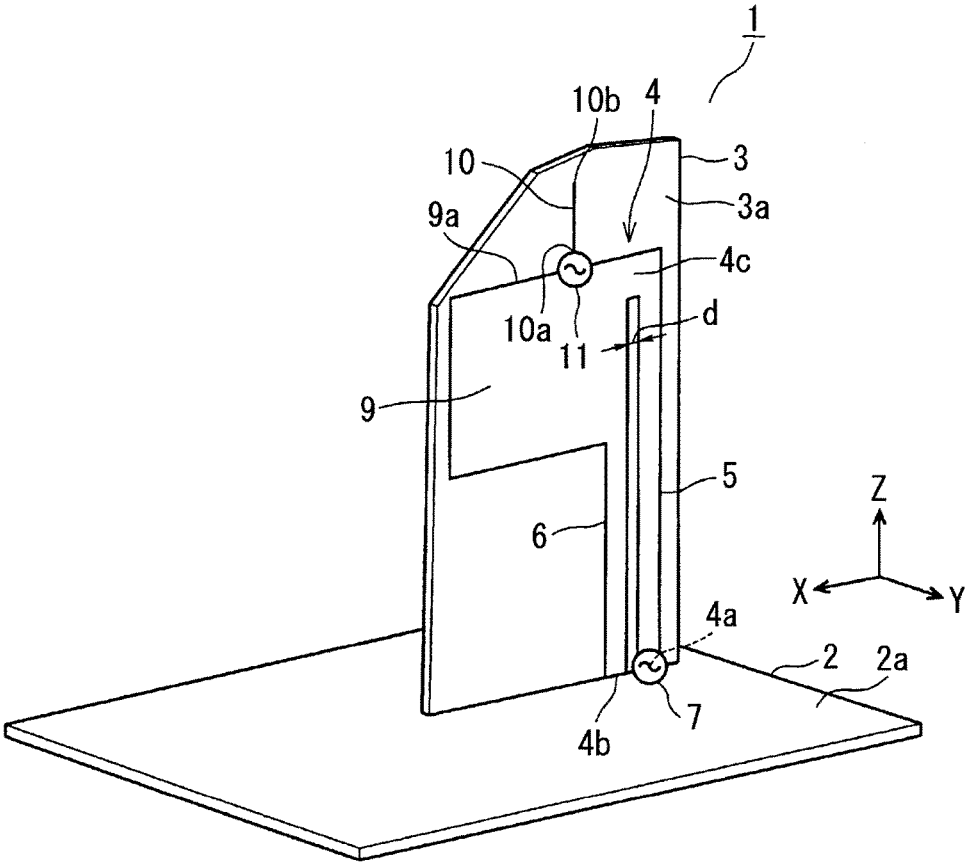
FIG. 1 is a diagram showing a perspective view of an antenna device according to a first embodiment of the present disclosure.

The following will describe an antenna device 1 according to a first embodiment of the present disclosure with reference to FIG. 1 to FIG. 5. The antenna device 1 includes an antenna element 10 that is utilized in a vehicle-to-vehicle communication system operating at a frequency band of 5.9 gigahertz (GHz) as an operating frequency band and an antenna element 4 that is utilized in a mobile phone system operating at a frequency band of 900 megahertz (MHz) as an operating frequency band. The antenna device 1 further includes a ground plate 2 having a planar shape. The ground plate 2 is provided by, for example, a metal plate having an approximately rectangular shape. The ground plate 2 is electrically connected with a metal body having a sufficiently large size relative to a wavelength of an operating frequency of the antenna element 4. Details of the antenna element 4 will be described later. A substrate 3 is disposed on an upper surface 2*a* of the ground plate 2 in a standing manner such that the substrate 3 is approximately perpendicular to the upper surface 2*a* of the ground plate 2. The substrate 3 is made of resin material and has a planar shape. Herein, the approximately perpendicular to includes a state that is close to a perpendicular state. The antenna element 4, which is provided by a folded monopole antenna element, is disposed on one face 3*a* of the substrate 3. The antenna element 4 is formed by a conductive pattern (conductive film). The folded monopole antenna element 4 is also referred to as a first antenna element, and the operating frequency band of the first antenna element, for example, 900 megahertz (MHz) band is also referred to as a first frequency band.

The first antenna element 4 transmits and receives radio waves of the mobile phone system that operates at the frequency band of, for example, 900 MHz band. The first antenna element 4 is electrically connected with (conductive with) the ground plate 2. The first antenna element 4 has a base end portion 4*a*, a front end portion 4*b*, and a folded portion 4*c*. The first antenna element 4 further has a side portion 5 that extends from the base end portion 4*a* to the folded portion 4*c* and a side portion 6 that extends from the folded portion 4*c* to the front end portion 4*b*. Hereinafter, the side portion 5 is also referred to as a first side portion, and the side portion 6 is also referred to as a second side portion. A length of each of the first side portion and the second side portion is electrically equal to a quarter wavelength. For example, the length of each of the first side portion and the second side portion is equal to a length acquired by multiplying a quarter wavelength of 900 MHz band radio wave by a wavelength shortening rate. Herein, the wavelength shortening rate is defined by a relative permittivity of material of the substrate 3. That is, a distance from the base end portion 4*a* of the first antenna element 4 to the front end portion 4*b* of the first antenna element 4 is equal to a value acquired by multiplying half wavelength of 900 MHz band radio wave by the wavelength shortening rate defined by the relative permittivity of the material of the substrate 3. Hereinafter, the distance from the base end portion 4*a* of the first antenna element 4 to the front end portion 4*b* of the first antenna element 4 is also referred to as an element length. An electrical potential of the front end portion 4*b* of the first antenna element 4 is equal to an electrical potential of the ground plate 2.

Figure 2:
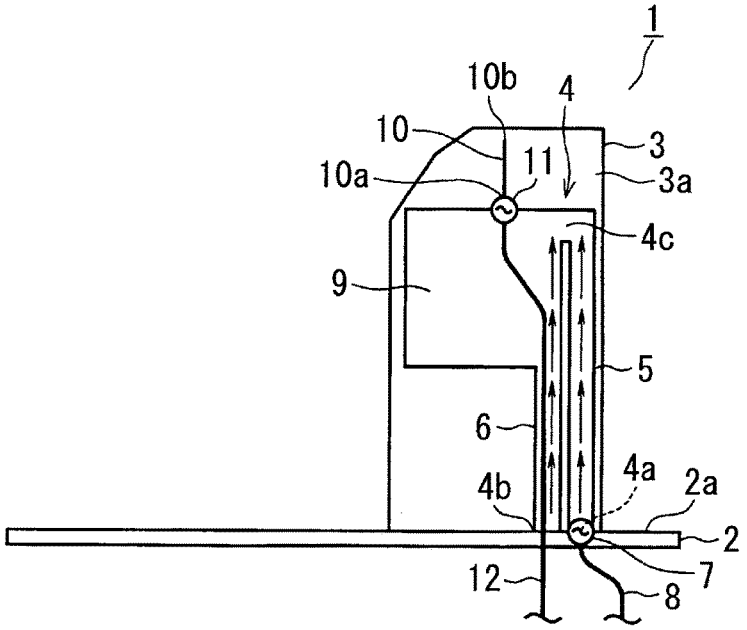
FIG. 2 is a diagram showing a front view of the antenna device according to the first embodiment.

A feeding point 7 that supplies power to the first antenna element 4 is disposed at the base end portion 4*a* of the first antenna element 4. The ground plate 2 functions as an antenna ground of the first antenna element 4. When the feeding point 7 is positioned apart from the first antenna element 4, the feeding point 7 may be electrically connected with the base end portion 4*a* of the first antenna element 4 via a microstripline. For example, as shown in FIG. 2, the feeding point 7 may be provided by a configuration in which an internal conductor of a coaxial cable 8 is connected with the base end portion 4*a* of the first antenna element 4 and an external conductor of the coaxial cable 8 is connected with the ground plate 2. As shown in FIG. 1, the first antenna element 4 is bended at the folded portion 4*c* such that a distance d (clearance) between the first side portion 5 and the second side portion 6 has a constant value along a direction perpendicular to the ground plate 2.

The second side portion 6 of the first antenna element 4 has a broad portion 9 that is formed integrally with an upper half portion of the second side portion 6 as one body. The broad portion 9 has a width greater than a width of other portion of the second side portion 6. The monopole antenna element 10 has a linear shape, and includes a base end portion 10*a* and a front end portion 10*b*. The base end portion 10*a* of the monopole antenna 10 is electrically connected with (conductive with) an upper end portion 9*a* of the broad portion 9 so that the base end portion 10*a* of the monopole antenna 10 is electrically connected with the broad portion 9. The monopole antenna element 10 is also referred to as a second antenna element, and the operating frequency band of the second antenna element, for example, 5.9 GHz band is also referred to as a second frequency band. The second antenna element 10 extends in an approximately vertical direction. That is, the second antenna element 10 is connected with the broad portion 9 such that the second antenna element 10 extends from the base end portion 10*a* to the front end portion 10*b* in a direction moving away from the broad portion 9. A length of the second antenna element 10 is electrically equal to a quarter wavelength. Hereinafter, the length of the second antenna element 10 is also referred to as an element length. For example, the element length of the second antenna element 10 may be set equal to a length acquired by multiplying a quarter wavelength of 5.9 GHz band radio wave by the wavelength shortening rate defined by the relative permittivity of the material of the substrate 3. For example, a width of the broad portion 9 in a direction horizontal to the ground plate 2 may be set greater than the length acquired by multiplying a quarter wavelength of 5.9 GHz band radio wave by the wavelength shortening rate defined by the relative permittivity of the material of the substrate 3.

A feeding point 11 that supplies power to the second antenna element 10 is disposed at the base end portion 10*a* of the second antenna element 10. The broad portion 9 functions as an antenna ground of the second antenna element 10. When the feeding point 11 is positioned apart from the second antenna element 10, the feeding point 11 may be electrically connected with the base end portion 10*a* of the second antenna element 10 via a microstripline. For example, as shown in FIG. 2, the feeding point 11 may be provided by a configuration in which an internal conductor of a coaxial cable 12 is connected with the base end portion 10*a* of the second antenna element 10 and an external conductor of the coaxial cable 12 is connected with the broad portion 9. The second antenna element 10 may have a predetermined width.

The antenna device 1 having above-described configuration is disposed in a casing (not shown), and the antenna device 1 together with the casing is attached to a vehicle roof such that a plane on which the ground plate 2 is disposed extends along (parallel to) an upper surface of the vehicle roof. That is, the antenna device 1 is attached to the vehicle such that an axis of the second antenna element 10 is perpendicular to the ground plate 2. Hereinafter, the axis perpendicular to the ground plate 2 is defined as a Z axis, an axis perpendicular to the Z axis and perpendicular to a plane on which the first antenna element 4 is disposed is defined as a Y axis, and an axis perpendicular to both the Z axis and the Y axis is defined as an X axis. That is, the X axis is parallel to the plane on which the first antenna element 4 is disposed. Further, a X-Y plane defined by the X axis and the Y axis is also referred to as a horizontal plane. That is, the horizontal plane refers to a plane that is parallel to the ground plate 2.

Figure 3:
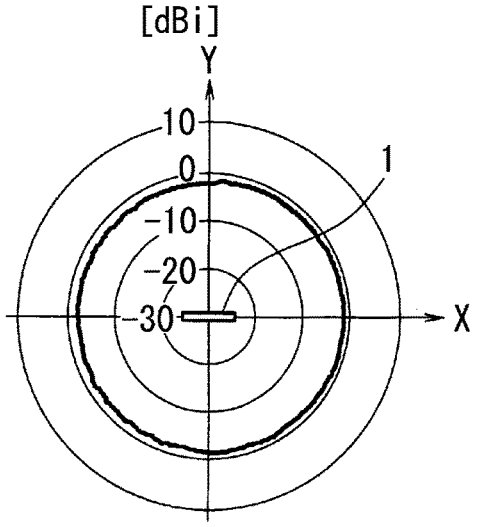
FIG. 3 is a diagram showing a directivity of the antenna device according to the first embodiment on a horizontal plane.
Figure 4:
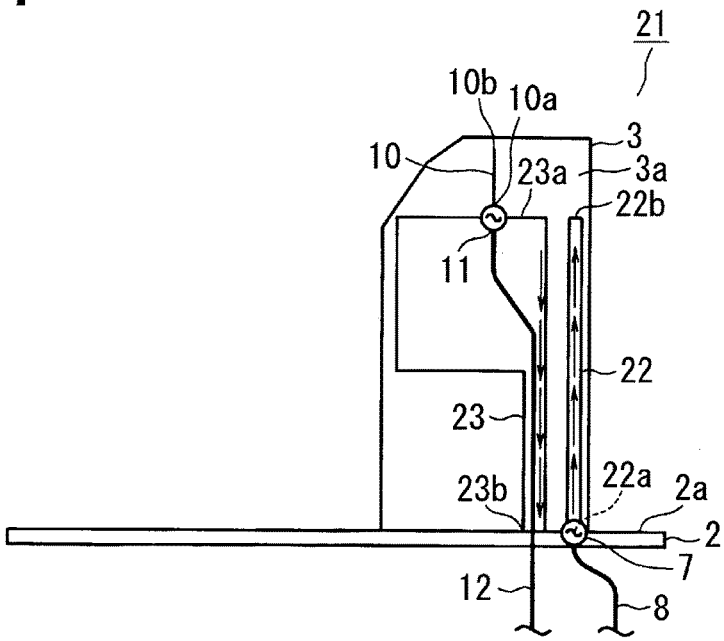
FIG. 4 is a diagram showing a front view of a comparison example of an antenna device.
Figure 5:
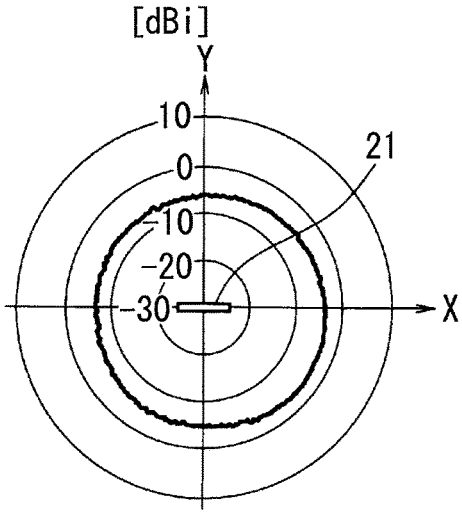
FIG. 5 is a diagram showing a directivity of the comparison example of the antenna device on a horizontal plane.

FIG. 3 shows a simulation result of a directivity of the first antenna element 4 on the horizontal plane. The first antenna element 4 has the configuration shown in FIG. 1 and is used in the mobile phone system operating at 900 MHz band. FIG. 4 shows an antenna device 21 as a comparison example. The antenna device 21 includes an unfolded monopole antenna element 22 as an antenna element for the mobile phone system operating at 900 MHz band. FIG. 5 shows a simulation result of a directivity of the antenna element 22 shown in FIG. 4 on the horizontal plane. As shown in FIG. 3 and FIG. 5, when the antenna element for the mobile phone system operating at 900 MHz band is provided by the folded monopole antenna element 4, a gain on the horizontal plane is improved by 3 decibels (dB) on average compared with the configuration in which the antenna element for the mobile phone system operating at 900 MHz band is provided by the unfolded monopole antenna element.

In the configuration shown in FIG. 4, the unfolded monopole antenna element 22 electrically couples with a ground pattern 23 that functions as an antenna ground of the monopole second antenna element 10, and induced currents having current vectors in opposite directions are generated and flow through the antenna elements. That is, when a current flows from the base end portion 22*a* of the antenna element 22 toward the front end portion 22*b* of the antenna element 22, an induced current flows from an upper end portion 23*a* of the ground pattern 23 toward a lower end portion 23*b* of the ground pattern 23. As a result, the gain of the antenna element 22 on the horizontal plane is decreased caused by a flow of the induced current.

Regarding above-described difficulty, in the antenna device 1 according to the present embodiment, the first antenna element 4 is provided by the folded monopole antenna element and the electrical potential of the front end portion 4*b* of the first antenna element 4 is set equal to the electrical potential of the ground plate 2. Thus, the first antenna element 4 becomes equivalent to half of a roof antenna that has an element length equal to one wavelength of the operating frequency band radio wave. Accordingly, in the first antenna element 4, a direction of the current vector in the base end portion 4*a* and in the front end portion 4*b* is opposite to a direction of the current vector in the folded portion (one corresponds to an anti-node and the other one corresponds to a node). As a result, a direction of the current vector in the first side portion 5 that extends from the base end portion 4*a* to the folded portion 4*c* is equal to a direction of the current vector in the second side portion 6 that extends from the folded portion 4*c* to the front end portion 4*b*. That is, the induced currents, which have current vectors having opposite directions and are canceled by one another, are restricted, and a decrease in gain of the first antenna element 4 on the horizontal plane is restricted.

As described above, in the antenna device 1 according to the present embodiment, the first antenna element 4 for the mobile phone system operating at 900 MHz band is provided by the folded monopole antenna element disposed on the ground plate 2 in a standing manner. The electrical potential of the front end portion 4*b* of the first antenna element 4 is set equal to the electric potential of the ground plate 2 so that the ground plate 2 functions as the antenna ground of the first antenna element 4. The second antenna element 10 for the vehicle-to-vehicle communication system operating at 5.9 GHz band is provided by the monopole antenna element, and the broad portion 9 of the first antenna element 4 functions as the antenna ground of the second antenna element 10. With this configuration, the folded monopole first antenna element 4 becomes equivalent to half of the roof antenna that has the element length equal to one wavelength of the operating frequency band radio wave. Further, even with the configuration in which the first antenna element 4 and the antenna element 10 are disposed, an improved directivity and an improved gain can be properly provided by the first antenna element 4 that is disposed on the ground plate 2 in a standing manner.

The second antenna element 10 operates with the broad portion 9 of the first antenna element 4 as the antenna ground. Thus, the first antenna element 4 and the second antenna element 10 can be disposed adjacent to each other with ease and a size of the antenna device 1 can be reduced. The antenna ground of the second antenna element 10 has a broad width. Thus, current paths can be increased and a frequency band can be broadened compared with a case in which the antenna ground of the second antenna element 10 has a small width.

As shown in the following fifth embodiment, when multiple antenna elements are attached to the vehicle roof, the vehicle roof usually functions as a common antenna ground of multiple antenna elements. Details of the fifth embodiment will be described later. However, when the vehicle roof is used as the common antenna ground, a wire circuit from each antenna element to the vehicle roof is necessary and a wire pattern is necessary to be formed on the substrate. Thus, a size of the antenna device can be increased. In the present embodiment, the second antenna element 10 operates with the broad portion 9 of the first antenna element 4 as the antenna ground. That is, a part of the first antenna element 4 provides the antenna ground of the second antenna element 10. Thus, there is no need to add the wire circuit or to form the wire pattern on the substrate. Thus, a size of the antenna device 1 can be reduced.

In the present embodiment, the antenna element (first antenna element 4) operating at a relatively low frequency is provided by the folded monopole antenna element, and the antenna element (second antenna element 10) operating at a relatively high frequency is provided by the monopole antenna element. As another example, the antenna element operating at a relatively low frequency may be provided by the monopole antenna element, and the antenna element operating at a relatively high frequency may be provided by the folded monopole antenna element.

However, in the antenna device according to the following fifth embodiment in which multiple antenna elements are attached to the vehicle roof, it is better that the antenna element (first antenna element 4) operating at a relatively low frequency is provided by the folded monopole antenna element, and the antenna element (second antenna element 10) operating at a relatively high frequency is provided by the monopole antenna element due to the following reasons. That is, the second antenna element 10 operating at a relatively high frequency may be disposed at an upper portion of the antenna device 1, and the first antenna element 4 operating at a relatively low frequency may be disposed at a lower portion of the antenna device 1.

A high frequency radio wave having a frequency around GHz band is more easily to be attenuated with an increase of a transmission distance. Thus, to secure a predetermined gain is especially important for the antenna device receiving the high frequency radio wave having the frequency around GHz band. However, the vehicle roof to which the antenna device 1 is attached is usually gently bended to have a gentle projected surface. When the antenna device is attached to a rear portion (REAR) of the vehicle roof, the projected portion of the vehicle roof exists at a front area (FRONT) of the antenna device as an obstacle. Thus, an improved directivity in the front direction of the vehicle is difficult to be secured.

As described in the present embodiment, the second antenna element 10 operating at a relatively high frequency is disposed on an upper side of the first antenna element 4 operating at a relatively low frequency. Thus, a visibility in front direction (field of front vision) of the vehicle viewed from the second antenna element 10 is improved and a directivity in the front direction of the vehicle can be properly secured compared with a case in which the first antenna element 4 operating at a relatively low frequency is disposed on an upper side of the second antenna element 10 operating at a relatively high frequency.

Second Embodiment

Figure 6:
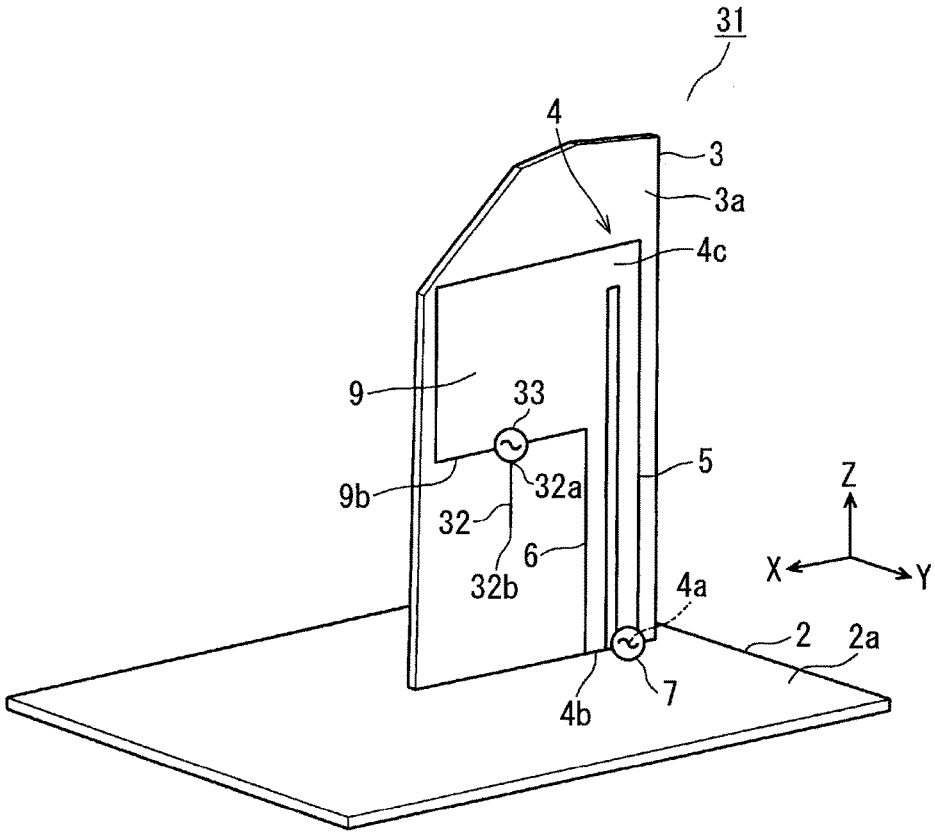
FIG. 6 is a diagram showing a perspective view of an antenna device according to a second embodiment of the present disclosure.

The following will describe an antenna device 31 according to a second embodiment of the present disclosure with reference to FIG. 6. A description of the same part with the above-described first embodiment will be omitted, and different parts will be described. The antenna device 31 according to the second embodiment includes a second antenna element 32, and a position of the second antenna element 32 with respect to the broad portion 9 of the first antenna element 4 is different from the antenna device 1 according to the first embodiment.

In the antenna device 31, the second antenna element 32 is provided by the monopole antenna element and has a linear shape. A base end portion 32*a* of the second antenna element 32 is electrically connected with (conductive with) a lower end portion 9*b* of the broad portion 9 such that the base end portion 32*a* is electrically connected with the broad portion 9. The second antenna element 32 extends in an approximately vertical direction. That is, the second antenna element 32 is connected with the broad portion 9 such that the second antenna element 32 extends from the base end portion 32*a* to the front end portion 32*b* in a direction moving away from the broad portion 9. A length of the second antenna element 32 is electrically equal to a quarter wavelength. For example, the length of the second antenna element 32 may be set equal to a length acquired by multiplying a quarter wavelength of 5.9 GHz band radio wave by the wavelength shortening rate defined by the relative permittivity of the material of the substrate 3. A feeding point 32 that supplies power to the second antenna element 32 is disposed at the base end portion 32*a* of the second antenna element 32. The broad portion 9 of the first antenna element 4 functions as an antenna ground of the second antenna element 32. The antenna device 31 according to the second embodiment provides advantages similar to the advantages provided by the antenna device 1 according to the first embodiment.

Third Embodiment

Figure 7:
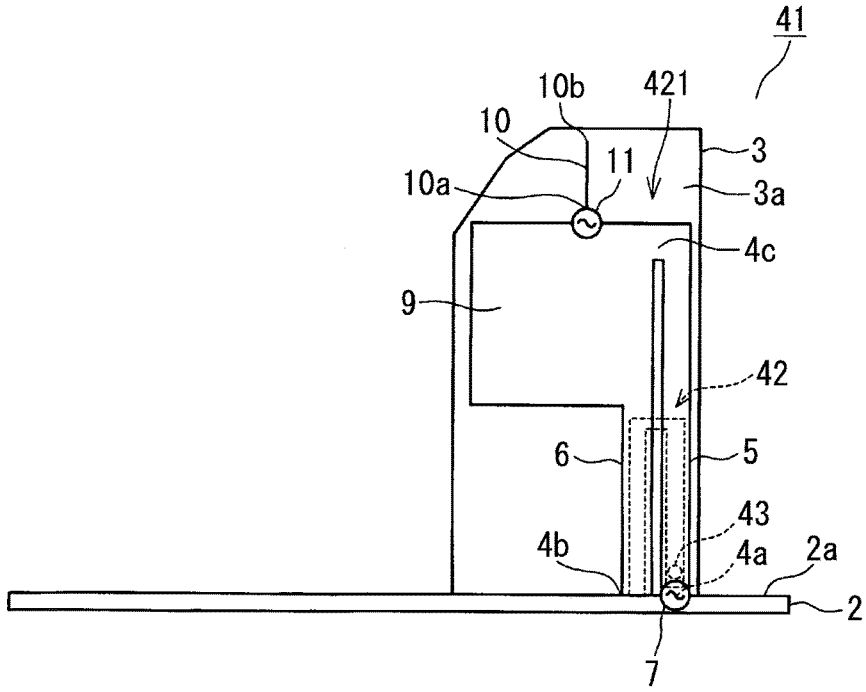
FIG. 7 is a diagram showing a front view of an antenna device according to a third embodiment of the present disclosure.
Figure 8:
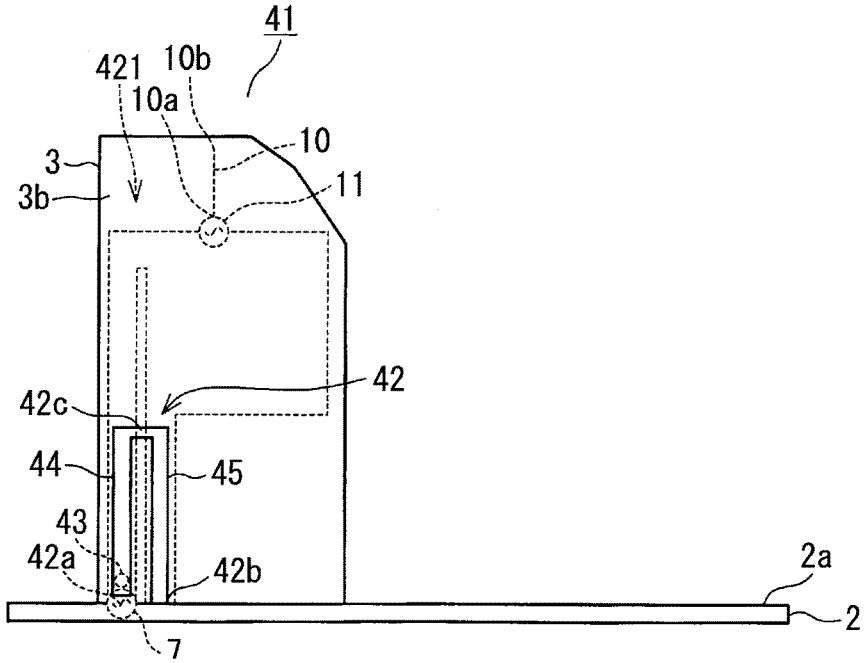
FIG. 8 is a diagram showing a back view of the antenna device according to the third embodiment.

The following will describe an antenna device 41 according to a third embodiment of the present disclosure with reference to FIG. 7 and FIG. 8. A description of the same part with the above-described first embodiment will be omitted, and different parts will be described. In the antenna device 41 according to the third embodiment, the first antenna element includes two first sub antenna elements 42, 421 provided by the folded monopole antenna elements, and the two first sub antenna elements 42, 421 are disposed on opposite faces of the substrate.

In the antenna device 41, the first sub antenna element 421 and the second antenna element 10 are disposed on one face 3*a* of the substrate 3. The first sub antenna element 421 corresponds to the first antenna element 4 of the first embodiment, and the second antenna element 10 is provided by the monopole antenna element. The first sub antenna element 421 has a configuration similar to the configuration of the first antenna element 4 of the first embodiment. The other first sub antenna element 42 is disposed on the other face 3*b* of the substrate 3, and the other first sub antenna element 42 is provided by a folded monopole antenna element and is formed by a conductive pattern.

The first sub antenna element 42 is an antenna element that transmits and receives radio waves for a mobile phone system operating at a frequency band of 2 gigahertz (GHz) band. A base end portion 42*a* of the first sub antenna element 42 is electrically connected with a base end portion 4*a* of the first sub antenna element 421 through a via hole 43. A front end portion 42*b* of the first sub antenna element 42 is electrically connected with the ground plate 2. For example, a length of each of a first side portion 44 and a second side portion 45 of the first sub antenna element 42 is electrically equal to a quarter wavelength. The first side portion 44 extends from the base end portion 42*a* of the first sub antenna element 42 to a folded portion 42*c* of the first sub antenna element 42. The second side portion 45 extends from the folded portion 42*c* of the first sub antenna element 42 to the front end portion 42*b* of the first sub antenna element 42. For example, the length of the first side portion and the second side portion is equal to a length acquired by multiplying a quarter wavelength of 2 GHz band radio wave by the wavelength shortening rate defined by the relative permittivity of the material of the substrate 3. That is, a distance from the base end portion 42*a* of the first sub antenna element 42 to the front end portion 42*b* of the first sub antenna element 42 is equal to a value acquired by multiplying half wavelength of 2 GHz band radio wave by the wavelength shortening rate defined by the relative permittivity of the material of the substrate 3. In the first sub antenna element 42, a distance between the first side portion 44 and the second side portion 45 has a constant value along a perpendicular direction. The folded portion 42*c* is sandwiched between the first side portion 44 and the second side portion 45.

The antenna device 41 according to the third embodiment provides advantages similar to the advantages provided by the antenna device 1 according to the first embodiment. That is, the first sub antenna element 421 disposed on the ground plate 2 in a standing manner can properly provide an improved directivity and gain. The other first sub antenna element 42 disposed on the ground plate 2 in a standing manner can also properly provide an improved directivity and gain. Further, in the present embodiment, the antenna device 41 corresponds to three different operating frequency bands, and can function as a multi frequency band antenna device. Further, the first sub antenna element 4 is disposed together with the other first sub antenna element 42 on the same substrate, and has the common feeding point 7. Thus, a configuration of the antenna device 41 can be simplified.

Fourth Embodiment

Figure 9:
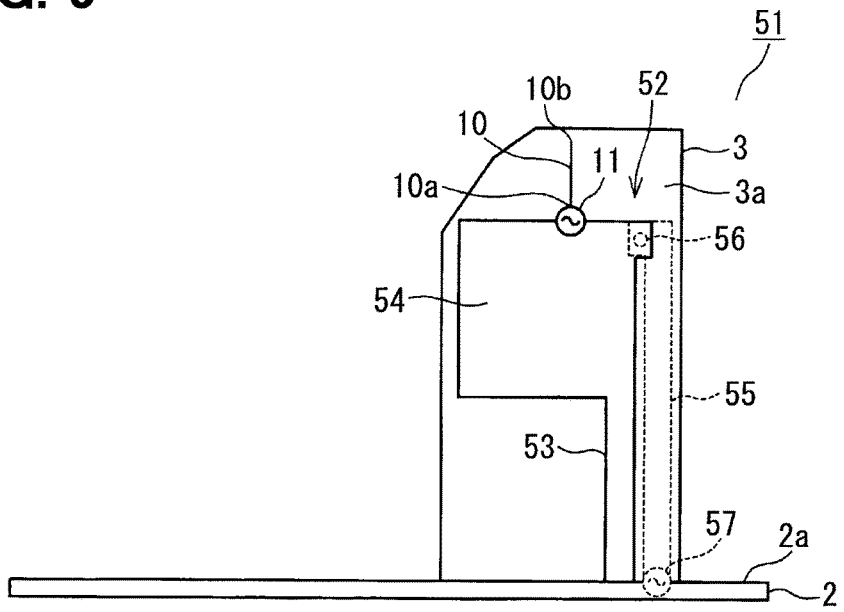
FIG. 9 is a diagram showing a front view of an antenna device according to a fourth embodiment of the present disclosure.
Figure 10:
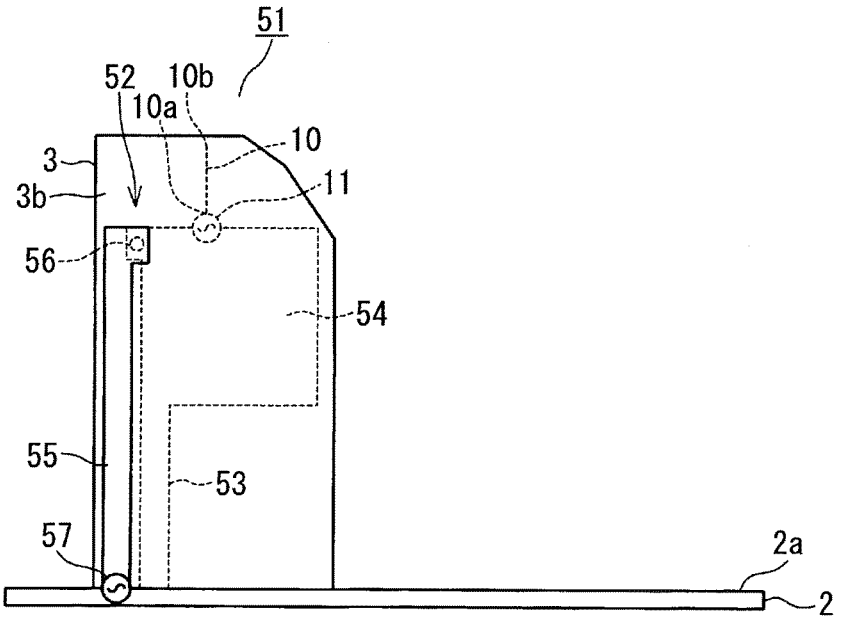
FIG. 10 is a diagram showing a back view of the antenna device according to the fourth embodiment.

The following will describe an antenna device 51 according to a fourth embodiment of the present disclosure with reference to FIG. 9 and FIG. 10. A description of the same part with the above-described first embodiment will be omitted, and different parts will be described. In the antenna device 51 according to the fourth embodiment, a first side portion 55 and a second side portion 53 of the first antenna element provided by a folded monopole antenna element are disposed on opposite faces of the substrate.

In the antenna device 51, a first antenna element 52 is disposed on the substrate 3. The first antenna element 52 corresponds to the first antenna element 4 of the first embodiment, and is provided by a folded monopole antenna element. In the antenna device 51, a second side portion 53 and a broad portion 54 are disposed on one face 3*a* of the substrate 3. The second side portion 53 corresponds to the second side portion 6 of the first embodiment, and the broad portion 54 corresponds to the broad portion 9 of the first embodiment. On the other face 3*b* of the substrate 3, a first side portion 55 is disposed. The first side portion 55 corresponds to the first side portion 5 of the first embodiment. The second side portion 53 is electrically connected with the first side portion 55 through a via hole 56. A feeding point 57 is disposed at a base end portion of the first side portion 55, and the second antenna element 10 is connected with the broad portion 54. The antenna device 51 according to the fourth embodiment provides advantages similar to the advantages provided by the antenna device 1 according to the first embodiment.

Fifth Embodiment

Figure 11:
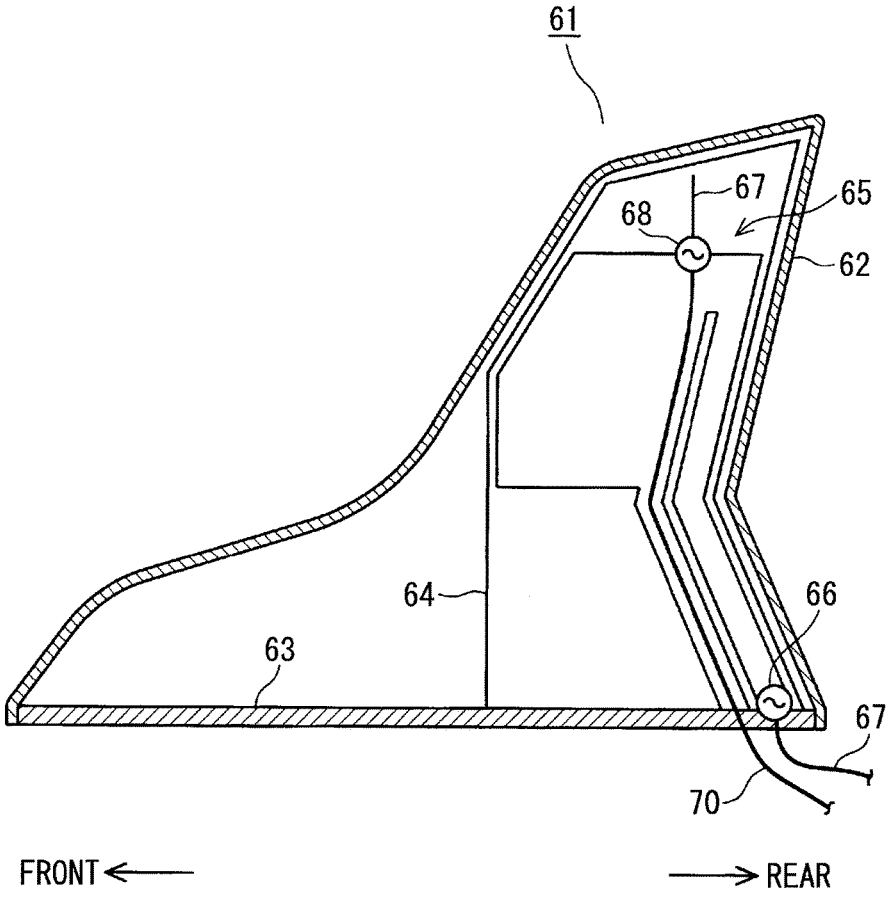
FIG. 11 is a diagram showing a front view of an antenna device according to a fifth embodiment of the present disclosure.

The following will describe an antenna device 61 according to a fifth embodiment of the present disclosure with reference to FIG. 11. A description of the same part with the above-described first embodiment will be omitted, and different parts will be described. The antenna device 61 according to the fifth embodiment includes a substrate 64 and a first antenna element 65 provided by a folded monopole antenna element. The substrate 64 and the first antenna element 65 are shaped to track a shape of a casing to be attached to the vehicle roof.

The antenna device 61 is disposed in the casing 62, and is attached to the vehicle roof under a state being disposed in the casing 62. The antenna device 61 includes a ground plate 63, the substrate 64, the first antenna element 65, a feeding point 66, a second antenna element 67 provided by a monopole antenna element, a feeding point 68, and coaxial cables 69, 70. The ground plate 63, the substrate 64, the first antenna element 65, the feeding point 66, the second antenna element 67, the feeding point 68, and the coaxial cables 69, 70 have functions similar to the functions of ground plate 2, the substrate 3, the first antenna element 4, the feeding point 7, the second antenna element 10, the feeding point 11, and the coaxial cables 8, 12 described in the first embodiment, respectively.

The antenna device 61 according to the fifth embodiment provides advantages similar to the advantages provided by the antenna device 1 according to the first embodiment. The first antenna element 65 is shaped to track the shape of the casing 62 to be attached to the vehicle roof. Specifically, the first antenna element 65 is bended at a center portion. Thus, a dimension of the first antenna element 65 can be reduced, and accordingly, a size of the antenna device 61 can be reduced compared with a case in which the antenna element having the same antenna length (current path length) is disposed in the antenna device without being bended. Even when the size of the antenna device 61 is reduced, the necessary antenna length can be secured and an improved antenna characteristic can be provided with the antenna device 61 of the present embodiment.

Sixth Embodiment

Figure 12:
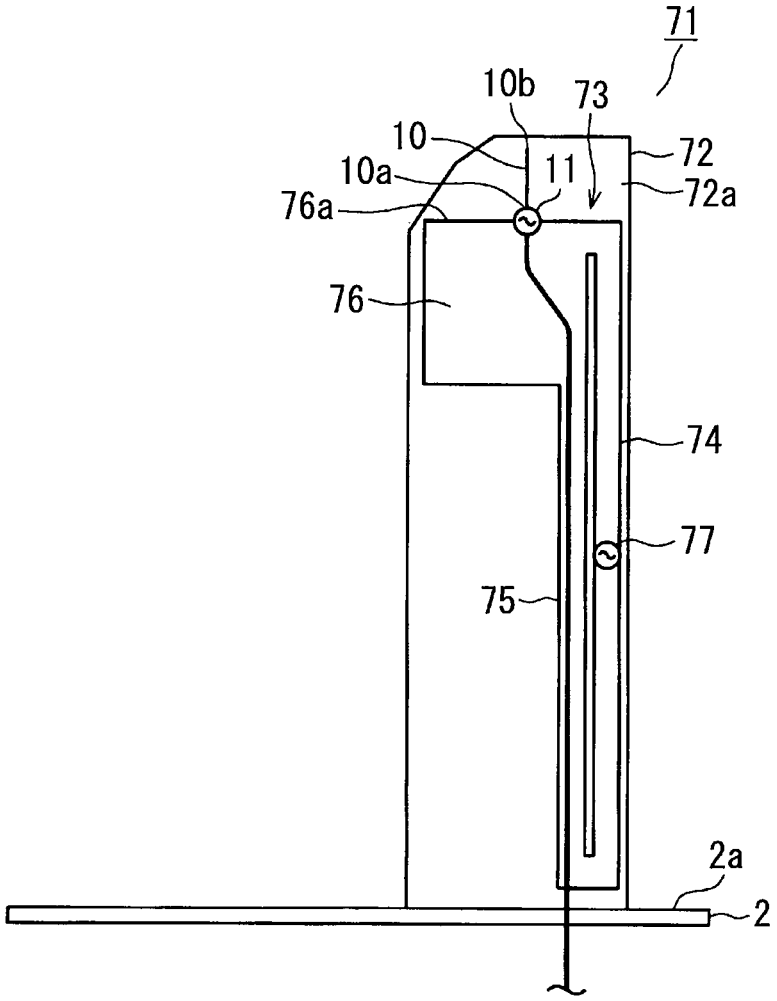
FIG. 12 is a diagram showing a front view of an antenna device according to a sixth embodiment of the present disclosure.

The following will describe an antenna device 71 according to a sixth embodiment of the present disclosure with reference to FIG. 12. A description of the same part with the above-described first embodiment will be omitted, and different parts will be described. The antenna device 71 according to the sixth embodiment, includes an antenna element (first antenna element 73), which is used for transmitting and receiving radio waves of the mobile phone system. The antenna element is provided by a folded dipole antenna element.

The antenna device 71 includes the first antenna element 73 disposed on one face 72*a* of a substrate 72. The first antenna element 73 is provided by a folded dipole antenna element, and is formed by a conductive pattern on one face 72*a* of the substrate 72. The first antenna element 73 includes two side portions including a first side portion 74 and a second side portion 75. A length of each of the first side portion 74 and the second side portion 75 is equal to a value acquired by multiplying half wavelength of 900 GHz band radio wave by a wavelength shortening rate. Herein, the wavelength shortening rate is defined by a relative permittivity of material of the substrate 72. That is, an entire length of the antenna element 73 (element length) is equal to a value acquired by multiplying the wavelength of 900 GHz band radio wave by the wavelength shortening rate defined by the relative permittivity of the material of the substrate 72.

The second side portion 75 has a broad portion 76 that is formed integrally with an upper half portion of the second side portion 75 as one body. The broad portion 76 of the second side portion 75 corresponds to the broad portion 9 of the first embodiment. A feeding point 77 is disposed at an approximately center portion of the first side portion 74, and the broad portion 76 is connected with the monopole second antenna element 10. The antenna device 71 according to the sixth embodiment provides advantages similar to the advantages provided by the antenna device 1 according to the first embodiment. The first antenna element 73 is provided by the folded dipole antenna element. Thus, the antenna device 71 according to the present embodiment is appropriate to be disposed on a portion that is separated from a body metal of the vehicle, for example, on a dashboard.

Seventh Embodiment

Figure 13:
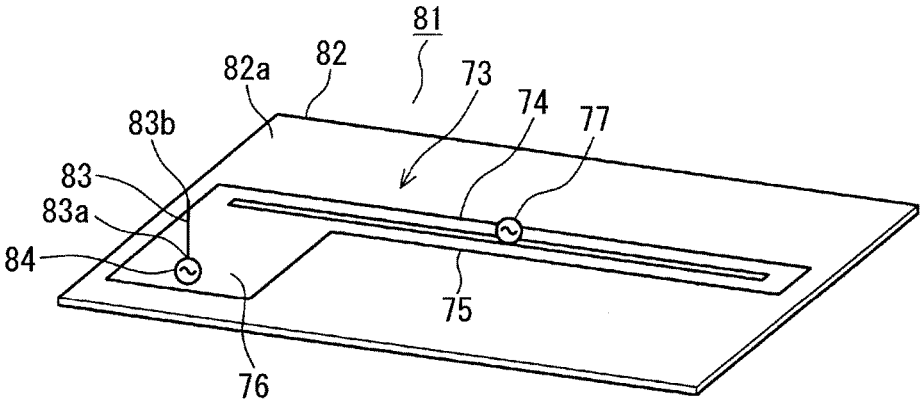
FIG. 13 is a diagram showing a perspective view of an antenna device according to a seventh embodiment of the present disclosure.

The following will describe an antenna device 81 according to a seventh embodiment of the present disclosure with reference to FIG. 13. A description of the same part with the above-described sixth embodiment will be omitted, and different parts will be described. In the antenna device 81 according to the seventh embodiment, a second antenna element 83 is disposed on a surface of a broad portion 76 of the first antenna element 73 in a standing manner, and is approximately perpendicular to the surface of the broad portion 76. The second antenna element 83 is provided by a monopole antenna element, and the first antenna element 73 is provided by a folded dipole antenna element.

In the antenna device 81, on one face 82*a* of a substrate 82, the first antenna element 73 provided by the folded dipole antenna element described in the sixth embodiment is disposed along the one face 82*a*. A base end portion 83*a* of the second antenna element 83, which is provided by the monopole antenna element and corresponds to the second antenna element 10 of the first embodiment, is electrically connected with the surface of the broad portion 76. The second antenna element 83 is disposed on the surface of the broad portion 76 in a standing manner and is approximately perpendicular to the surface of the broad portion 76. That is, the second antenna element 83 is connected with the broad portion 76 such that the second antenna element 83 extends from the base end portion 83*a* to the front end portion 83*b* in a direction perpendicular to the surface of the broad portion 76 moving away from the broad portion 76. A feeding point 84 is disposed at the base end portion 83*a* of the second antenna element 83. The antenna device 81 according to the seventh embodiment provides advantages similar to the advantages provided by the antenna device 1 according to the sixth embodiment.

Other Embodiments

The antenna devices according to foregoing embodiments are used in the vehicle-to-vehicle communication system and the road-to-vehicle communication system. The antenna device according to the present disclosure may also be applied to a vehicle antenna device used in a different communication system other than the road-to-vehicle communication system and the vehicle-to-vehicle communication system. The antenna device according to the present disclosure may also be applied to an antenna device attached to a target other than the vehicle.

The substrate of the antenna device according to the present disclosure may be provided by a multi-layer substrate, and multiple antenna elements may be formed on different layers of the same multi-layer substrate. The substrate may be provided by a flexible substrate that is flexible at a predetermined level. Further, the substrate may be provided by a substrate on which electronic components can be mounted on a surface of the flexible substrate. That is, under a condition that multiple antenna elements can be formed on the substrate, the substrate may be provided by any type of substrate. Similarly, the ground plate on which the substrate is disposed in a standing manner can be provided by a plate that is curved at a predetermined level under a condition that the ground plate is able to function as the antenna ground of the antenna element.

The antenna element may be provided by a metal plate.

While the disclosure has been described with reference to preferred embodiments thereof, it is to be understood that the disclosure is not limited to the preferred embodiments and constructions. The disclosure is intended to cover various modification and equivalent arrangements. In addition, while the various combinations and configurations, which are preferred, other combinations and configurations, including more, less or only a single element, are also within the spirit and scope of the disclosure.

What is claimed is:

1. An antenna device comprising:

a first antenna element operating at a first predetermined frequency band; and a second antenna element operating at a second predetermined frequency band that is different from the first predetermined frequency band, wherein the first antenna element includes a base end portion, a front end portion, a folded portion, a first side portion disposed between the base end portion and the folded portion, and a second side portion disposed between the folded portion and the front end portion, wherein a direction of a current vector in the first side portion is parallel to a direction of a current vector in the second side portion, wherein the second antenna element is disposed adjacent to the first antenna element, wherein a feeding point of the first antenna element is disposed at a position in a vicinity of a ground plate, and a feeding point of the second antenna element is disposed at a position in a vicinity of the folded portion of the first antenna element, wherein the feeding point of the second antenna element is a part of the first antenna element, wherein the second antenna element is disposed at a position higher than the first antenna element with respect to the ground plate, and wherein the second antenna element directly extends in a direction perpendicular to the folded portion of the first antenna element.

2. The antenna device according to claim 1, further comprising the ground plate having a planar shape, wherein the first antenna element is disposed on the ground plate in a standing manner, wherein the folded portion of the first antenna element is bent so that a distance between the first side portion and the second side portion at the folded portion has a constant value, wherein the first antenna element is provided by a folded monopole antenna element that operates with the ground plate as an antenna ground, and wherein an electrical potential of the front end portion is equal to an electrical potential of the ground plate.

3. The antenna device according to claim 1, wherein the second antenna element operates with a part of the first antenna element as an antenna ground.

4. The antenna device according to claim 1, wherein the first antenna element includes a plurality of first sub antenna elements.

5. The antenna device according to claim 4, wherein the plurality of first sub antenna elements have a common feeding point that supplies power to the plurality of first sub antenna elements.

6. The antenna device according to claim 4, wherein the plurality of first sub antenna elements are disposed on a substrate.

7. The antenna device according to claim 1, wherein a substrate is provided by a multi-layer substrate having multiple layers, wherein the first side portion of the first antenna element is disposed on one layer of the multi-layer substrate, and wherein the second side portion of the first antenna element is disposed on another layer of the multi-layer substrate.

8. The antenna device according to claim 1, wherein a distance between the feeding point of the second antenna element and the first side portion of the first antenna element is longer than a distance between the feeding point of the second antenna element and the second side portion of the first antenna element.

9. The antenna device according to claim 1, wherein the direction of the current vector in the first side portion is the same as the direction of the current vector in the second side portion.

10. The antenna device according to claim 1, wherein the first and second side portions are formed by a conductive pattern disposed on a substrate.

11. The antenna device according to claim 1, wherein the first and second side portions extend perpendicular to the ground plate.

12. The antenna device according to claim 1, wherein the antenna device is attached to a vehicle roof, and the ground plate is disposed along an upper surface of the vehicle roof.

13. The antenna device according to claim 12, wherein the second antenna element operates at a higher frequency than the first antenna element, the vehicle roof has a projected surface and the antenna device is attached to a rear portion of the vehicle roof, and the second antenna element is disposed higher than the first antenna element with respect to the vehicle roof.

14. The antenna device according to claim 12, wherein the second antenna element is provided by a monopole antenna element and an axis of the second antenna element is perpendicular to the ground plate.

15. An antenna device comprising:

a first antenna element operating at a first predetermined frequency band; and a second antenna element operating at a second predetermined frequency band that is different from the first predetermined frequency band, wherein the first antenna element includes a base end portion, a front end portion, a folded portion, a first side portion disposed between the base end portion and the folded portion, and a second side portion disposed between the folded portion and the front end portion, wherein a direction of a current vector in the first side portion is parallel to a direction of a current vector in the second side portion, wherein the second antenna element is disposed adjacent to the first antenna element, wherein a feeding point of the first antenna element is disposed at a position in a vicinity of a ground plate, and a feeding point of the second antenna element is disposed at a position in a vicinity of the folded portion of the first antenna element, wherein the feeding point of the second antenna element is a part of the first antenna element, wherein the second antenna element is disposed at a position higher than the first antenna element with respect to the ground plate, wherein the second antenna element directly extends in a direction perpendicular to the folded portion of the first antenna element, wherein the first antenna element includes a plurality of first sub antenna elements, and wherein the plurality of first sub antenna elements have a common feeding point that supplies power to the plurality of first sub antenna elements.

* * * * *